United States Patent [19]

Davies et al.

[11] 4,429,270

[45] Jan. 31, 1984

[54] SWITCHED CURRENT SOURCE FOR SOURCING CURRENT TO AND SINKING CURRENT FROM AN OUTPUT NODE

[75] Inventors: Robert B. Davies; Ira Miller, both of Tempe, Ariz.

[73] Assignee: Motorola, Inc., Schaumburg, Ill.

[21] Appl. No.: 352,905

[22] Filed: Feb. 26, 1982

[51] Int. Cl.[3] ..... G05F 3/08

[52] U.S. Cl. ..... 323/317; 307/354

[58] Field of Search ..... 323/315-317; 307/253, 254

[56] References Cited

U.S. PATENT DOCUMENTS 4,051,428 9/1977 Imai ..... 323/317

4,092,552 5/1978 Hoehn ..... 307/254

4,339,669 7/1982 Jarrett et al. ..... 307/254

*Primary Examiner*—William H. Beha, Jr.

*Attorney, Agent, or Firm*—Vincent B. Ingrassia

[57] ABSTRACT

A gated current source includes a first current source for generating a first current which is supplied to the anode of a diode. A second switched current source is also coupled to the anode of the diode and produces a second current which is greater than the first current. When the switched current source is off, a current is supplied to an output node via the diode. When the switched current source is on, a different current is pulled from the the output node via a transistor having a base coupled to the output node and an emitter coupled to the anode of the diode.

5 Claims, 1 Drawing Figure

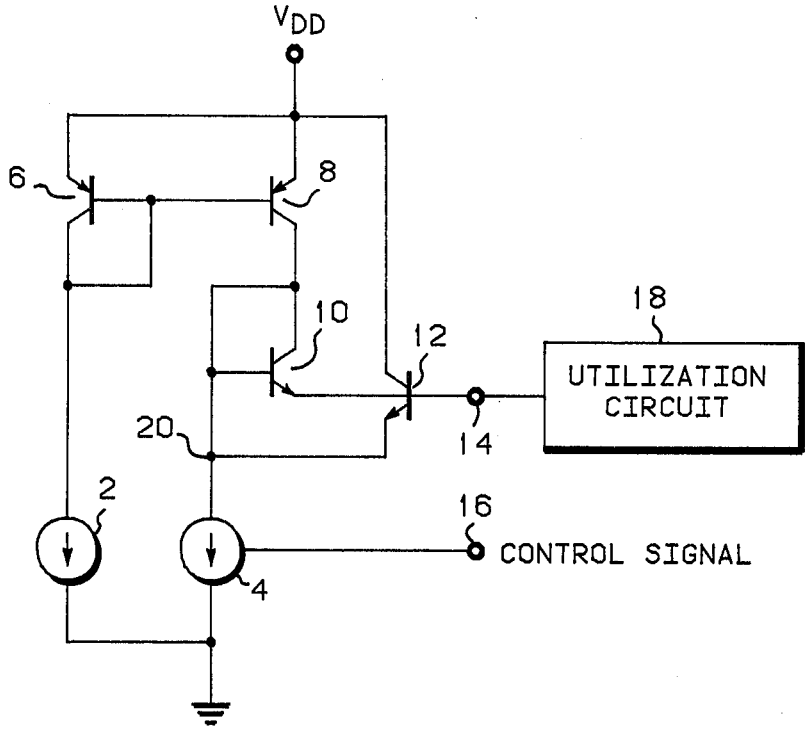
VDD
6
8
10
12
18
UTILIZATION CIRCUIT
14
20
2
16
CONTROL SIGNAL
4

SWITCHED CURRENT SOURCE FOR SOURCING CURRENT TO AND SINKING CURRENT FROM AN OUTPUT NODE

BACKGROUND OF THE INVENTION

FIELD OF THE INVENTION

This invention relates generally to a current switch and, more particularly, to a circuit for selectively sourcing a first current to a utilization circuit and sinking a second current from the utilization device.

Circuits which selectively source or sink current to and from a node which is in turn coupled to a utilization circuit generally comprise a current source, a gated current sink, and first and second diodes or first and second transistors to assure that the current sourced to the node and the current pulled from the node are substantially equal. A need exists, however, for a simple circuit which will source a first current and sink a second current of a magnitude which is different from that of the sourced current.

SUMMARY OF THE INVENTION

It is an object of the present invention to provide an improved current switch.

It is a further object of the present invention to provide an improved switched current source which selectively sources or sinks first or second currents respectively, the first and second currents being unequal.

According to a first aspect of the invention there is provided a switched current source for sourcing current to and sinking current from an output node adapted to be coupled to a utilization circuit, comprising: first current source means for producing a first current; a gated current source for producing a second current when said gated current source is switched on, said second current being greater than said first current; diode means having an anode coupled at a junction point between said first current source means and said gated current source and having a cathode coupled to said node, said diode means for supplying said first current to said output node when said gated current source is off; and a first transistor having a collector adapted to be coupled to a source of supply voltage, an emitter coupled to said junction, and a base coupled to said cathode and to said output node, said first transistor sinking a third current from said output node when said gated current source is on.

According to a further aspect of the invention there is provided a switched current source for sourcing current to and sinking current from an output node adapted to be coupled to a utilization circuit, comprising: a first current source for producing a first current, said first current source having a first terminal adapted to be coupled to a first supply potential and having a second terminal; current mirror means coupled to said second terminal and adapted to be coupled to a second supply potential for reproducing said first current at its output; a gated current source for producing a second current when said gated current source is switched on, said second current being greater than said first current; and a second transistor having a collector adapted to be coupled to said second supply potential, an emitter coupled to the base and collector of said first transistor and to the second terminal of said gated current source, and a base coupled to the emitter of said first transistor and to said output node for sinking a third current from said output node when said gated current source is on.

BRIEF DESCRIPTION OF THE DRAWING

The above and other objects, features and advantages of the present invention will be better understood from the following detailed description taken in conjunction with the accompanying drawing in which is a schematic diagram of the inventive current switch.

DESCRIPTION OF THE PREFERRED EMBODIMENT

Referring to the drawing, the inventive current switch comprises first and second current sources 2 and 4 respectively each having one terminal coupled to ground, first and second transistors 6 and 10 respectively, coupled as diodes (i.e. their base and collector electrodes are coupled together), a transistor 8 having its emitter coupled to a source of supply voltage $V_{DD}$, and a transistor 12 having a collector coupled to $V_{DD}$, a base coupled to the emitter of transistor 10 and to output node or terminal 14, which node is in turn coupled to utilization circuit 18 (not considered a part of this invention but including, for example, a capacitor coupled to node 14 which is alternately charged and discharged by the circuit).

A second terminal of current source 2 is coupled to the base/collector of transistor 6, and the emitter of transistor 6 is coupled to $V_{DD}$. The collector of transistor 8 and the emitter of transistor 12 are coupled to the base/collector of transistor 10.

Current source 2 is a fixed current source which generates, for example, 150 $\mu$A of current. Current source 4 is a gate current source which is selectively turned on and off by a control signal supplied to terminal 16 by external circuitry. For example, when the control signal is in a first state, current source 4 is turned on and generates, for example, 250 $\mu$A of current. When the control signal appearing at terminal 16 is in a second state, current source 4 is turned off and generates no current. For the sake of completeness, gated current source 4 may comprise a transistor having its emitter/-collector path coupled between ground and the base/-collector of transistor 10 and having its base coupled to terminal 16 for receiving the control signal.

The circuit operates as follows: Assume that current source 2 produces 150 $\mu$A and that gated current source 4 produces 250 $\mu$A when on and 0 $\mu$A when off. Due to the current mirror action of transistor/diode 6 and transistor 8, a current of 150 $\mu$A will flow in the collector of transistor 8. If current source 4 is switched off, current will flow to node 14 and therefore to utilization circuit 18 via the emitter of transistor 10. If, on the other hand, current source 4 where switched on, transistor 10 would become reverse biased, and transistor 12 would turn on pulling current from node 14. This will provide a current component flowing into node 20 from the emitter of transistor 12 which when added to the 150 $\mu$A flowing from the collector of transistor 8 will produce the required 250 $\mu$A. Thus, when current source 4 is off, approximately 150 $\mu$A will be sourced to node 14; however, when current source 4 is on, approximately 100 $\mu A/\beta$ will be pulled from node 14 where $\beta$ is the current gain of transistor 12. Transistor 12 thus acting as an emitter follower limits the lower voltage transition of node 20 to the voltage at node 14 minus the base-emitter voltage of transistor 12. This in turn prevents the transistor output of controlled current source 4 from saturating, thus avoiding the reduction in switching speed associated with a saturated transistor.

The above description is given by way of example only. Changes in form and details may be made by one skilled in the art without departing from the scope of the invention. For example, the transistors employed may be either NPN or PNP transistors depending on the nature of the utilization circuit.

We claim:

1. A switched current source for sourcing current to and sinking current from an output node connectable to a utilization circuit, comprising:

first current source means for producing a first current;

a gated current source for producing a second current when said gated current source is switched on, said second current being greater than said first current;

diode means having an anode coupled at a junction point between said first current source means and said gated current source and having a cathode coupled to said node, said diode means for supplying said first current to said output node when said gated current source is off; and a first transistor having a collector connectable to a source of supply voltage, an emitter coupled to said junction, and a base coupled to said cathode and to said output node, said first transistor sinking a third current from said output node when said gated current source is on.

2. A switched current source according to claim 1 wherein said diode means comprises a second transistor having its base and collector terminals coupled together and to said junction and having an emitter coupled to the base of said first transistor and to said output node.

3. A switched current source according to claim 2 wherein said first current source means comprises:

a first current source for generating said first current; and current mirror means coupled to said first current source and to said diode means for supplying said first current thereto.

4. A switched current source according to claim 3 wherein said first current is smaller than said second current.

5. A switched current source for sourcing current to and sinking current from an output node connectable to a utilization circuit, comprising:

a first current source for producing a first current, said first current source having a first terminal connectable to a first supply potential and having a second terminal;

current mirror means coupled to said second terminal and connectable to a second supply potential for reproducing said first current at its output;

a gated current source for producing a second current when said gated current source is switched on, said second current being greater than said first current; and a first transistor having a collector connectable to said second supply potential, an emitter coupled to said gated current source, and a base coupled to said output node for sinking a third current from said output node when said gated current source is on.

* * * * *